US008459864B2

(12) United States Patent
Galletti

(10) Patent No.: US 8,459,864 B2
(45) Date of Patent: Jun. 11, 2013

(54) MIXTURE FOR CONCRETE AND SIMILAR MIXTURES ALLOWING AN EASY AND FAST MAINTENANCE

(75) Inventor: Paolo Galletti, Ponte Valleceppi (IT)

(73) Assignee: Officine Meccaniche Galletti O.M.G. Srl, Perugia (IT)

( * ) Notice: Subject to any disclaimer, the term of this patent is extended or adjusted under 35 U.S.C. 154(b) by 893 days.

(21) Appl. No.: 12/450,812

(22) PCT Filed: Jan. 8, 2008

(86) PCT No.: PCT/EP2008/050153

§ 371 (c)(1),
(2), (4) Date: Oct. 14, 2009

(87) PCT Pub. No.: WO2008/128795

PCT Pub. Date: Oct. 30, 2008

(65) Prior Publication Data

US 2010/0110821 A1 May 6, 2010

(30) Foreign Application Priority Data

Apr. 18, 2007 (IT) ..... MC20070021 U

(51) Int. Cl.
*B01F 7/02* (2006.01)

(52) U.S. Cl.
USPC ..... 366/331

(58) Field of Classification Search
USPC ..... 366/66, 297, 298, 299, 300, 301, 366/331, 349, 608, 279
See application file for complete search history.

(56) References Cited

U.S. PATENT DOCUMENTS

| | | | | |
|---|---|---|---|---|
| 3,125,211 | A * | 3/1964 | Macy | 198/674 |
| 3,563,515 | A * | 2/1971 | Chapman et al. | 366/298 |
| 3,924,835 | A * | 12/1975 | Hohnfeld et al. | 366/293 |
| 4,504,253 | A * | 3/1985 | Buschbom et al. | 474/114 |
| 4,865,289 | A * | 9/1989 | Lawson | 248/666 |
| 6,331,070 | B1 * | 12/2001 | Desai | 366/197 |
| 6,431,755 | B1 * | 8/2002 | Schneider | 384/50 |
| 7,160,023 | B2 * | 1/2007 | Freude et al. | 366/273 |
| 2010/0110821 | A1 * | 5/2010 | Galleti | 366/66 |

FOREIGN PATENT DOCUMENTS

| | | | |
|---|---|---|---|
| EP | 0407013 | A1 | 1/1991 |
| FR | 2438762 | | 5/1980 |
| FR | 2438762 | * | 6/1980 |

OTHER PUBLICATIONS

International Search Report of corresponding application No. PCT/EP2008/050153 mailed Apr. 21, 2008.

* cited by examiner

*Primary Examiner* — Tony G Soohoo
(74) *Attorney, Agent, or Firm* — Lowe Hauptman Ham & Berner, LLP

(57) ABSTRACT

The present invention relates to a mixer for concrete and similar mixtures, of the type composed of a parallelepiped tank (2) internally provided with one or more mixing shafts (3), each of them driven into rotation by a corresponding motor unit (UM) in external position with respect to the tank (2), which comprises, with the necessary connections, an electric motor (4), a gear motor (6) and an intermediate gear (7) interfaced with the end of the corresponding mixing shaft (3), characterised by the fact that the electrical motor (4) and the corresponding gear motor (6) of each motor unit (UM) are fixed to a single bearing frame (8) that is hung to the border of the tank (2) by means of one or more hinges (9).

3 Claims, 2 Drawing Sheets

MIXTURE FOR CONCRETE AND SIMILAR MIXTURES ALLOWING AN EASY AND FAST MAINTENANCE

The present patent application relates to a mixer for concrete, powders, dry and semi-dry granules characterised by easy and fast maintenance.

As it is known, the traditional mixers used in the most diverse sectors are composed of a large parallepiped tank with cylindrical or omega-shaped walls, in which one or more rotational shafts operate horizontally to mix the mixtures loaded in the tank.

The said shafts are provided with radial blades designed to interfere efficaciously interference with the mixture to be mixed.

The transversal borders of the tank are provided with housings used to insert the mixing shafts, with the interposition of suitable bearings and seal gaskets.

The big and heavy motor units designed to drive the said mixing shafts into rotation are mounted in external position on one or both transversal borders.

Each motor unit is composed of an electric motor that actuates, either directly or by means of a transmission belt, a gear motor that transmits the rotational motion to the mixing shaft with the interposition of a series of intermediate and reducing gears.

The electrical motor, together with the rest of the gear motor, is fixed and supported against the bearing border of the tank by means of a fixed frame or a suitable bell.

More precisely, the frame that support the electrical motor is fixed towards the end of the bearing border, while the bell of the gear motor is fixed in the attachment point of the mixing shaft to the bearing border.

The said mixers require periodical maintenance of the attachment units mounted in the housings provided on the borders of the tanks, in which the ends of the mixing shafts are inserted.

The presence of the said attachment units, as well as their perfect efficiency, is indispensable to prevent the mixture from leaking outside of the tank and reaching the mechanisms of the motor units that actuate the mixing shafts.

However, the maintenance operations of the attachment units are extremely delicate, due to the fact that they are situated on the border of the mixing tank immediately behind the motor units.

This means that each attachment units can be accessed by the maintenance operators only after dismounting the gear motor of the motor unit.

This operation is rather complicated and difficult, since it requires to dismount the belt that connects the gear motor and the electrical motor, remove the means used to fix the gear motor bell against the bearing border of the tank and finally attach the gear motor to a lifting device to remove it from the mixing tank.

The use of a lifting device is extremely delicate, considering that concrete mixers are usually operated at a considerable height from the ground, being supported by suitable supports, or in closed environments (sun as in mixing towers).

Moreover, serious risks for the operators are involved, due to the presence of heavy suspended loads.

The purpose of the present invention is to devise a mixer with a traditional structure able to provide practical, easy and fast access to the attachment units that require maintenance on a periodical basis.

To that end, all the components of each motor unit of the mixer of the invention is supported by a single frame that is hung to the border of the mixing tank by means of two or more sturdy hinges, and not directly screwed onto the said border.

The aforementioned general description allows to understand the advantages of such an innovative solution.

As a matter of fact, the use of hinges as support means for the motor units makes it possible to remove the motor unit by means of a simple backward rotation with respect to the vertical axis that passes through the pivots of the hinges, in order to access the attachment unit.

Since the electrical motor and the gear motor of the said motor unit are fixed onto the same frame, these two components are jointly involved in the backward rotation.

This condition is particularly advantageous since, unlike the prior technique, it avoids the need to dismount the transmission belt provided between the electrical motor and the gear motor to access the attachment unit.

In view of the above, the entire motor unit can be easily and quickly moved from a working position, in which it is fixed against the external side of the bearing border, to an inoperative position, in which it is removed from the border according to an angular direction.

As soon as the maintenance operations of the attachment units have been completed, each motor unit can recover its working position by means of a simple rotation in reverse direction.

The fact that the motor unit is capable of making alternative rotations avoids the need to use a crane or other lifting device, and allows to execute the entire sequence of operations with a single operator, without requiring any physical effort and without generating any risks for the operator's safety.

Another peculiarity of the present invention consists in the fact that it is provided, in intermediate position between the traditional gear motor of each motor unit and the end of the corresponding mixing shaft, with a coupling made of two matchable sections (practically speaking, two "semi-couplings").

In particular, the first semi-coupling is permanently fixed at the end of the mixing shaft, while the second semi-coupling is fixed to the gear motor of the motor unit.

This means that, after being uncoupled, the semi-coupling fixed to the gear motor is removed from the corresponding semi-coupling fixed at the end of the mixing shaft.

Such a removal between the two semi-couplings is produced when the entire motor unit (attached to the first semi-coupling) rotates backwards around the corresponding hinges.

It must be noted that, the attachment unit of each mixing shaft can be accessed after dismounting the semi-coupling that is directly connected with the mixing shaft, that is to say in a faster and more comfortable way with respect to traditional mixers in which the entire cascade of intermediate and reducing gears provided in intermediate position between the gear motor of each motor unit and the corresponding mixing shaft must be removed.

For major clarity the description of the invention continues with reference to the enclosed drawing, which is intended for purposes of illustration only and not in a limiting sense, whereby:

Figure 1:
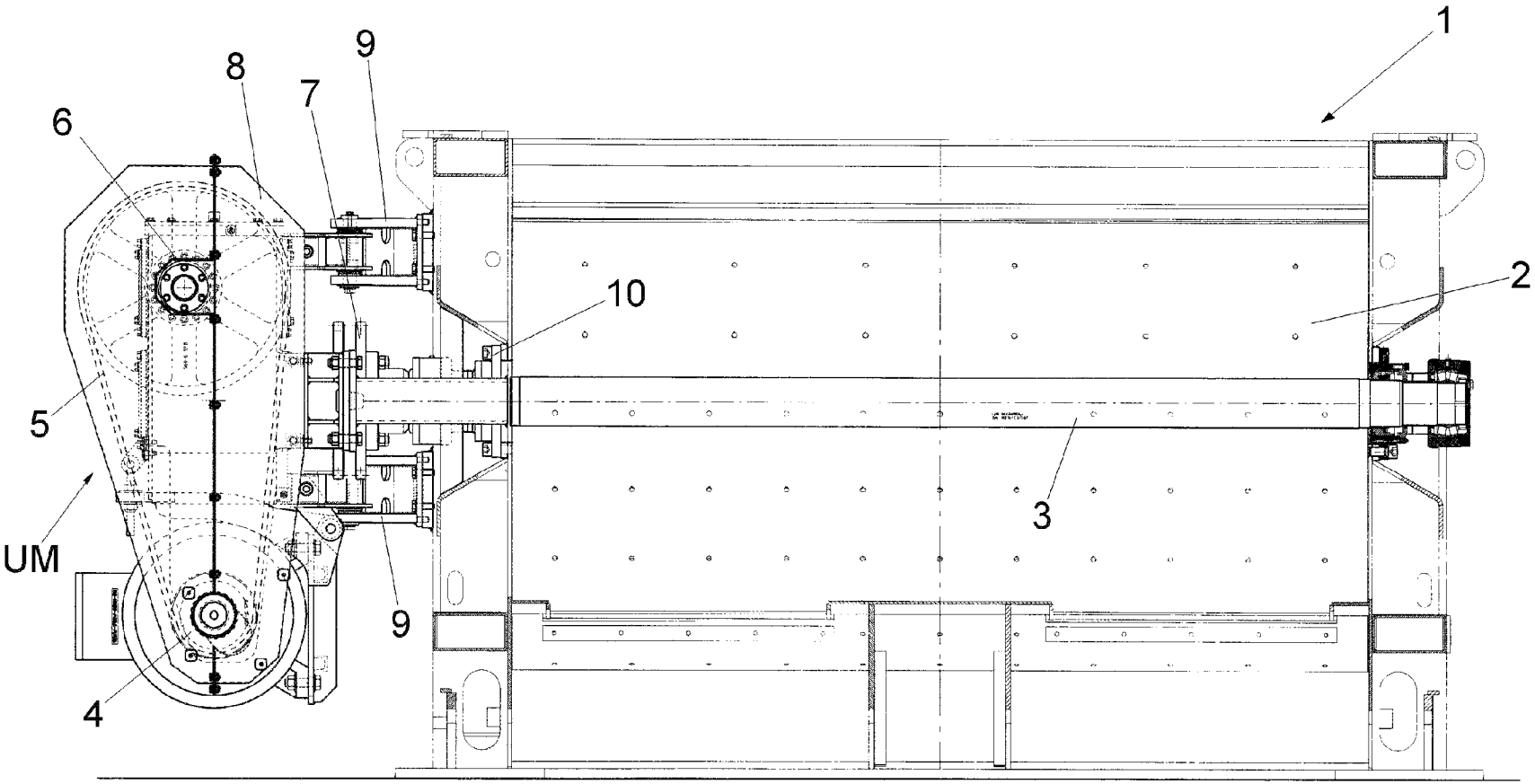
FIG. 1 is a side view of the mixer of the invention, with a sectional view of the tank.

With reference to the said figures, the mixer (1) is traditionally composed of a parallepiped tank (2) provided with one or more rotational mixing shafts (3) horizontally supported between the transversal borders.

Each shaft (3) is actuated by a corresponding motor unit (UM) composed of an electric motor (4) connected by means of a belt (5) to a gear motor (6) connected to the end of the corresponding mixing shaft (3) by means of a coupling (7).

All the said components of the motor unit (UM) are fixed to the same support frame (8) that is supported by one or more fixing elements—practically speaking, hinges (9)—in external position on the corresponding border o the mixing tank (2).

As anticipated, the presence of the said hinges (9) allows the frame (8) and the components of the motor unit (UM) to be moved alternatively from a working position (in close contact with the border of the mixing tank) to a non-working position (away from the same border) to perform maintenance operations of the attachment unit (10) of the mixing shaft (3).

Figure 2:
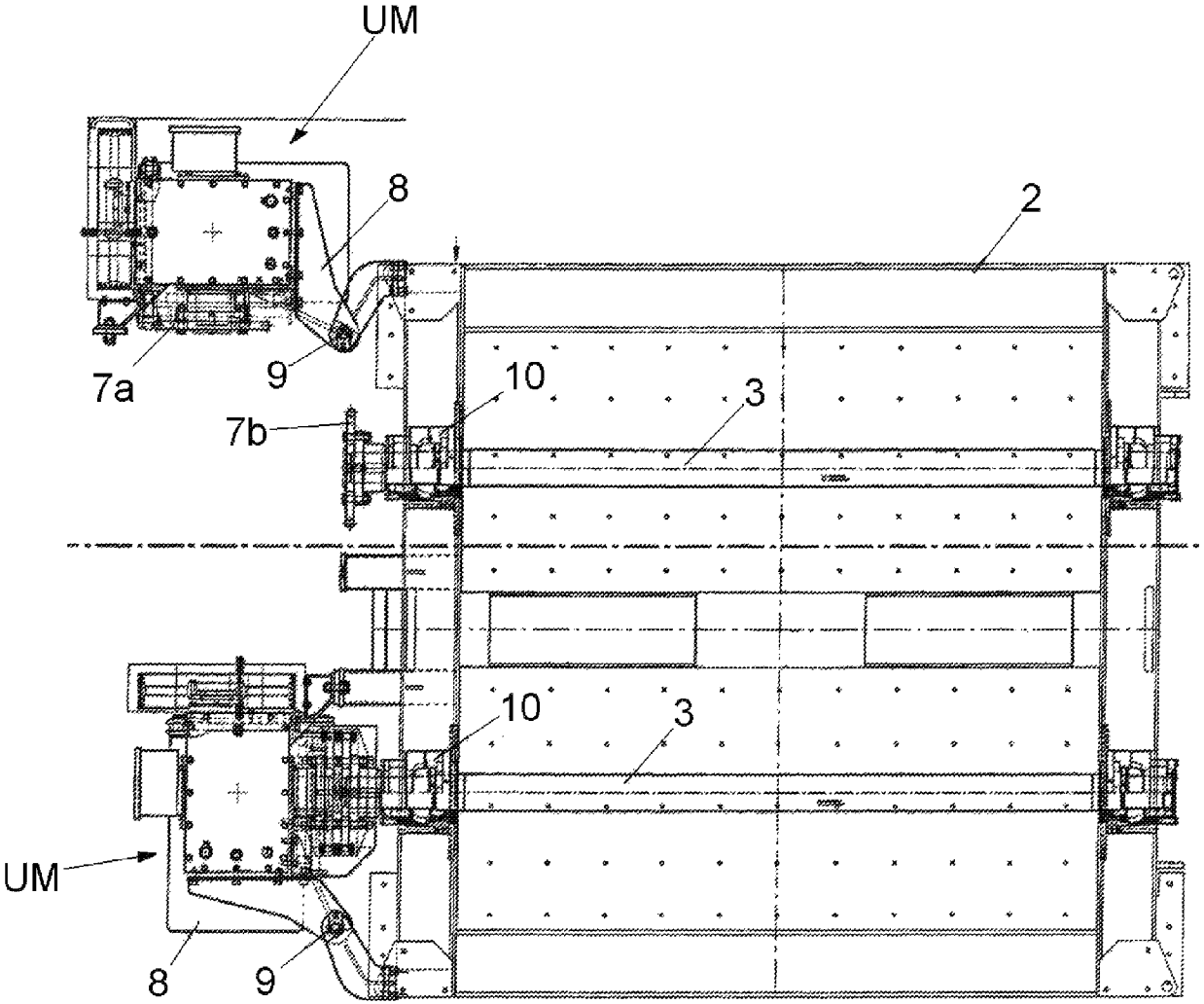
FIG. 2 is a top view of the same mixer.

The capability of the frame (8) to make an alternative rotation is expressly shown in FIG. 2, which shows two motor units (UM) of the same mixer (1), one in working position and another one in inoperative position.

The same FIG. 2 also shows the structure and operating modes of the coupling (7) positioned between the gear motor (6) of each motor unit (UM) and the corresponding mixing shaft (3).

When the motor unit (UM) is in working position, the two semi-couplings (7*a*, 7*b*) of the coupling are frontally matched.

When it is necessary to bring the motor unit (UM) in inoperative position, the two semi-couplings (7*a*, 7*b*) are disconnected and uncoupled.

After such an operation, the first semi-coupling (7*a*) remains joined to the gear motor (6) of the motor unit (UM), and the second semi-coupling (7*b*) remains joined with the end of the mixing shaft (3), from which it is then removed to provide access to the attachment units (10).

The invention claimed is:

1. Mixer for concrete and similar mixtures, of the type composed of a parallelepiped tank internally provided with one or more mixing shafts, each of said one or more mixing shafts driven into rotation by a corresponding motor unit (UM) in external position with respect to the tank, said motor unit comprises an electric motor, a gear motor and an intermediate gear interfaced with an end of one of the one or more mixing shafts, wherein the electric motor and the gear motor of each motor unit are fixed to a bearing frame that is hung on a border of the tank by one or more hinges.

2. The mixer as claimed in claim 1, wherein the electric motor and the gear motor of each motor unit are fixed to the bearing frame.

3. The mixer as claimed in claim 1, wherein the intermediate gear provided between the gear motor and the end of one of the one or more mixing shafts comprises a coupling composed of two cooperating semi-couplings rigidly connectable to each other, the first semi-coupling being joined to the gear motor, and the second semi-coupling being joined to the end of one or more mixing shafts.

* * * * *